US010005531B1

(12) United States Patent
Broadway et al.

(10) Patent No.: US 10,005,531 B1
(45) Date of Patent: Jun. 26, 2018

(54) ARC CRANK

(71) Applicant: Hobie Cat Company, a Missouri corporation, Oceanside, CA (US)

(72) Inventors: William John Broadway, Oceanside, CA (US); Gregory Scott Ketterman, Carlsbad, CA (US); James Taylor Czarnowski, Fallbrook, CA (US); Jason Christopher Kardas, Oceanside, CA (US); Philip James Dow, Oceanside, CA (US); Drew William Brackett, Carlsbad, CA (US); Shane Yellin, Carlsbad, CA (US); Elizabeth Catherine Sexton, San Clemente, CA (US)

(73) Assignee: Hobie Cat Company, Oceanside, CA (US)

( * ) Notice: Subject to any disclaimer, the term of this patent is extended or adjusted under 35 U.S.C. 154(b) by 0 days. days.

(21) Appl. No.: 15/678,441

(22) Filed: Aug. 16, 2017

Related U.S. Application Data

(60) Provisional application No. 62/532,105, filed on Jul. 13, 2017.

(51) Int. Cl.

| | |
|---|---|
| ***B63H 1/36*** | (2006.01) |
| ***B63H 16/20*** | (2006.01) |
| ***B63B 35/71*** | (2006.01) |

(52) U.S. Cl.
CPC ..... *B63H 1/36* (2013.01); *B63B 35/71* (2013.01); *B63H 16/20* (2013.01); *B63B 2035/715* (2013.01); *B63B 2754/00* (2013.01); *B63H 2016/202* (2013.01)

(58) Field of Classification Search
CPC ... B63H 1/00; B63H 1/30; B63H 1/32; B63H 1/36; B63H 16/08; B63H 16/12; B63H 16/18; B63H 16/20
USPC ..... 440/13, 15, 21
See application file for complete search history.

(56) References Cited

U.S. PATENT DOCUMENTS

| | | | |
|---|---|---|---|
| 2,003,934 | A | 6/1935 | Hansel |
| 2,286,914 | A | 6/1942 | Knapp |
| 2,873,713 | A | 2/1959 | Baastrup |
| 2,948,255 | A | 8/1960 | Sbrana |
| 3,695,211 | A | 10/1972 | Gross |
| 3,986,473 | A | 10/1976 | Truzzi |
| 4,427,392 | A | 1/1984 | Schneider |
| 4,490,119 | A | 12/1984 | Young |
| 4,936,802 | A | 6/1990 | Ueno |
| 4,960,396 | A | 10/1990 | Stolzer |
| 5,460,551 | A | 10/1995 | Beres |

(Continued)

FOREIGN PATENT DOCUMENTS

| | | |
|---|---|---|
| GB | 452719 | 8/1936 |
| JP | 52-033290 | 3/1977 |

(Continued)

*Primary Examiner* — Lars A Olson
(74) *Attorney, Agent, or Firm* — Joseph E. Mueth

(57) ABSTRACT

An apparatus for adjusting a human propelled watercraft having a pair of flexible fins extending into the water. The invention allows the user to easily adjust the propulsion device to match the user's leg length. The invention consists of a push button mechanism that converts a vertical motion into a horizontal motion allowing a locking pin to retract and the propulsion device to be adjusted. Once an adjustment position is selected, the user releases the button and a spring reverses the motion of the pin, locking the mechanism into position.

14 Claims, 9 Drawing Sheets

(56) References Cited

U.S. PATENT DOCUMENTS

| | | | |
|---|---|---|---|
| 6,022,249 | A | 2/2000 | Ketterman |
| 7,637,791 | B2 | 12/2009 | Ketterman |
| 9,359,052 | B2 | 6/2016 | Ketterman |

FOREIGN PATENT DOCUMENTS

| | | |
|---|---|---|
| JP | 01-144198 | 10/1989 |
| JP | 03-035897 | 4/1991 |

SECTION A-A

ARC CRANK

Applicant claims the benefit of U.S. Provisional Patent Application Ser. No. 62/532,105, filed Jul. 13, 2017.

FIELD OF INVENTION

The present invention relates generally to an apparatus for adjusting a human propelled watercraft for different human leg lengths.

BACKGROUND OF INVENTION

The prior art, the pedal propulsion system described in Ketterman, U.S. Pat. No. 6,022,249, the disclosure of which is expressly incorporated herein by reference, allows the user to adjust the pedals forward and backward to accommodate different human leg lengths. The pedal support and cable guide of the drive has multiple predefined adjustment holes. The slidable pin locks into these holes and translates the user's pedal force by means of the pedal shafts into the drive system.

SUMMARY OF THE INVENTION

An apparatus adapted to be placed in a watercraft extending through an opening in the direction of the watercraft, said apparatus comprising a propulsion means comprising a pair of flexible fins extending below the waterline adapted to oscillate through an arcuate path about a horizontal axis to propel said watercraft and means operatively associated with said propulsion means for applying input force including a pair of flexible drive members running from said propulsion means to rotatable supports having a plurality of spaced apart adjustment holes therein, said flexible drive members being coupled to each of said rotatable supports, a pair of elongated members each carrying a pedal, each said elongated member having a locking means therein slidably engageable and disengageable with said adjustment holes, said locking means being operatively coupled to manually operable means at the distal end of said elongated member whereby when said manually operable means is depressed, said locking means is withdrawn from said adjustment holes and said elongated member can be rotated relative to said rotatable support and when said elongated member is rotated so that said locking means is aligned with another adjustment hole and said manually operable means is released, said elongated member is locked to said rotatable support by said locking means and said pedal is positioned according to the leg length of the user and when input force is applied to said pedals, said flexible fins oscillate through an arcuate path.

A watercraft comprising an apparatus extending through an opening in the bottom of said watercraft, said device comprising a pair of flexible fins extending below the waterline adapted to oscillate through an arcuate path about a horizontal axis to propel said watercraft and means operatively associated with said propulsion means for applying input force including a pair of flexible drive members running from said propulsion means to rotatable supports having a plurality of spaced apart adjustment holes therein, said supports carrying said flexible drive members being coupled to each of said rotatable supports, a pair of elongated members each carrying a pedal, each said elongated member having a locking means therein slidably engageable and disengageable with said adjustment holes, said locking means being operatively coupled to manually operable means at the distal end of said elongated member, whereby when said manually operable means is depressed, said locking means is withdrawn from said adjustment holes and said elongated member can be rotated relative to said rotatable support and when said elongated member is rotated so that said locking means is aligned with another adjustment hole and said manually operable means is released, said elongated member is locked to said rotatable support by said locking means and said pedal is positioned according to the leg length of the user and when input force is applied to said pedals, said flexible fins oscillate through an arcuate path.

The invention allows a push of a button to retract the slidable pin from the drive drum to make an adjustment forwards or backwards. The core component is constrained by the hollow tube and the sliding pin. The sliding pin has a smaller transverse pin embedded halfway down its axial length. This transverse pin fits inside of a sloped track within the one-piece push button mechanism. As the button is depressed, the transverse pin is forced down the sloped track. The core is constrained within the tube and only moves in the vertical plane, the sliding pin moves only in the horizontal plane. The sloped surface converts the vertical motion to horizontal, retracting the sliding pin from the adjustment holes from the drum. With the button fully depressed, the user can move the tube forwards and backwards within the drum cavities' range of motion. A new position can be selected according to the individual's leg length.

As the button is released, a spring located at the base of the push button forces the transverse pin to travel back up the sloped track forcing the sliding pin back into its original protruding position and into a new adjustment hole. The invention allows the user to clearly identify and operate the adjustable pedal function of the flexible fin propulsion systems.

THE DRAWINGS

Turning to the drawings.

DESCRIPTION OF THE PREFERRED EMBODIMENTS

Figure 1:
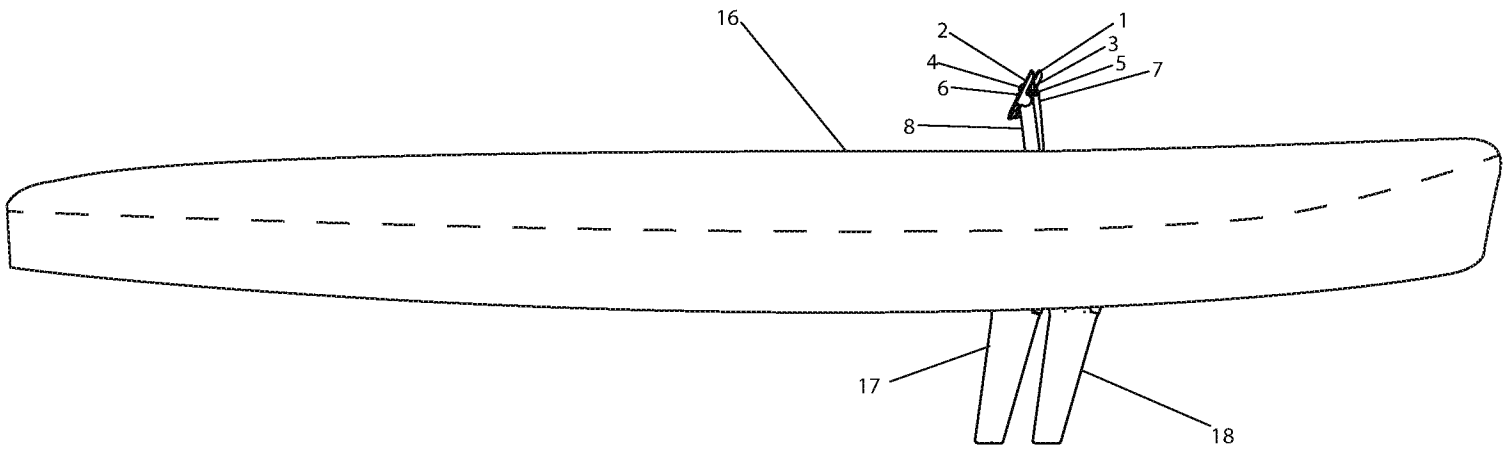
FIG. 1 is a side view of a kayak equipped with the device of the present invention.
Figure 2:
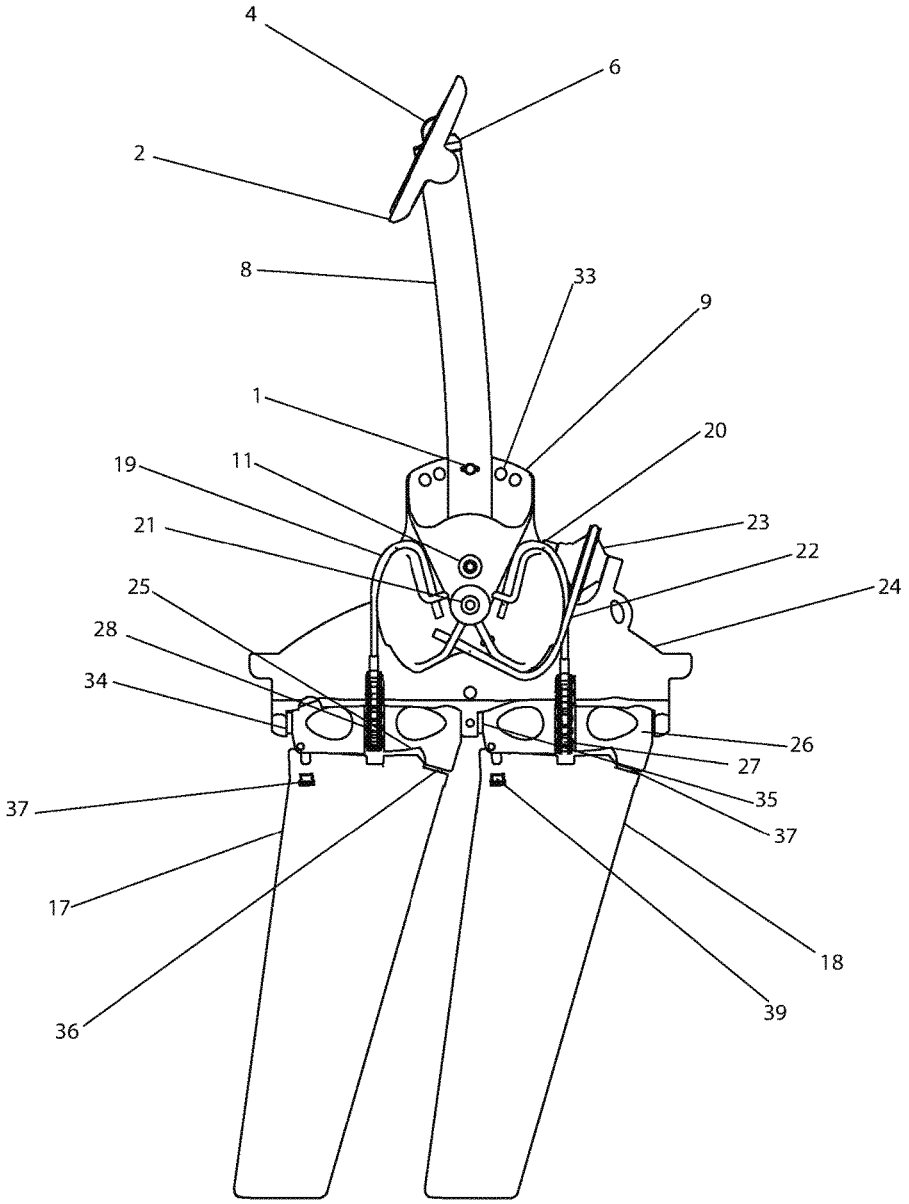
FIG. 2 is a side view of the invention attached to a human propulsion device.
Figure 3:
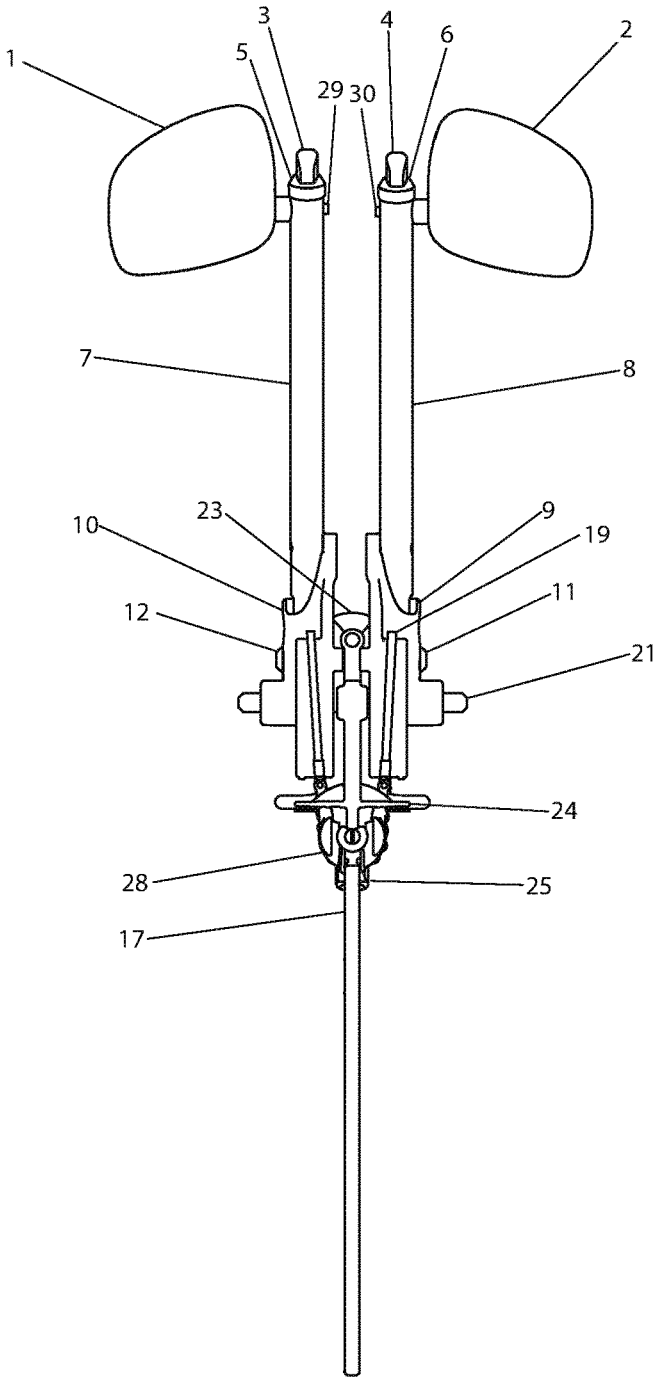
FIG. 3 is a rear view of the invention attached to a human powered propulsion device.
Figure 4:
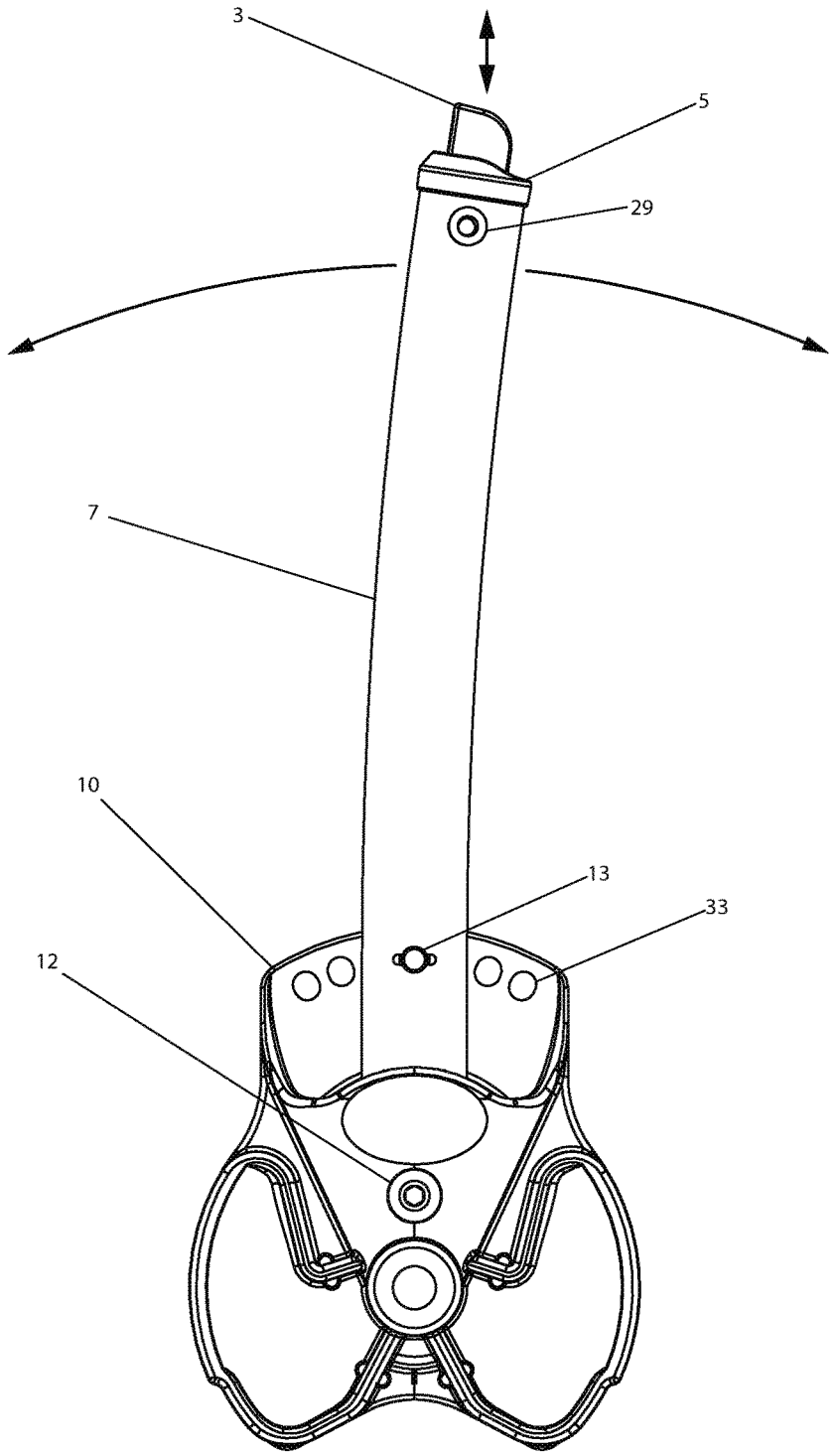
FIG. 4 is a side view of the invention showing the range of adjustment using the invention.
Figure 5:
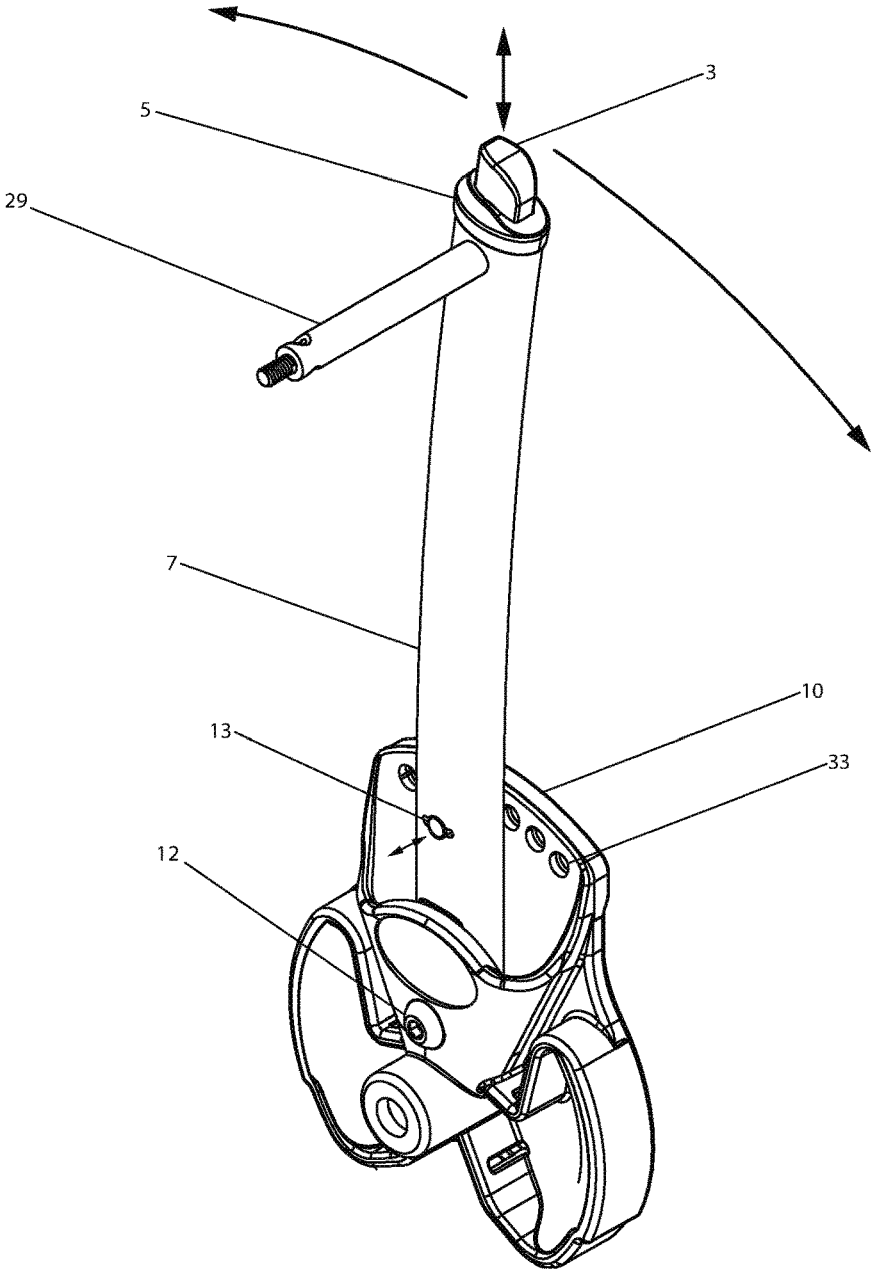
FIG. 5 is an isometric view of the invention showing the rage of adjustment using the invention.
Figure 6:
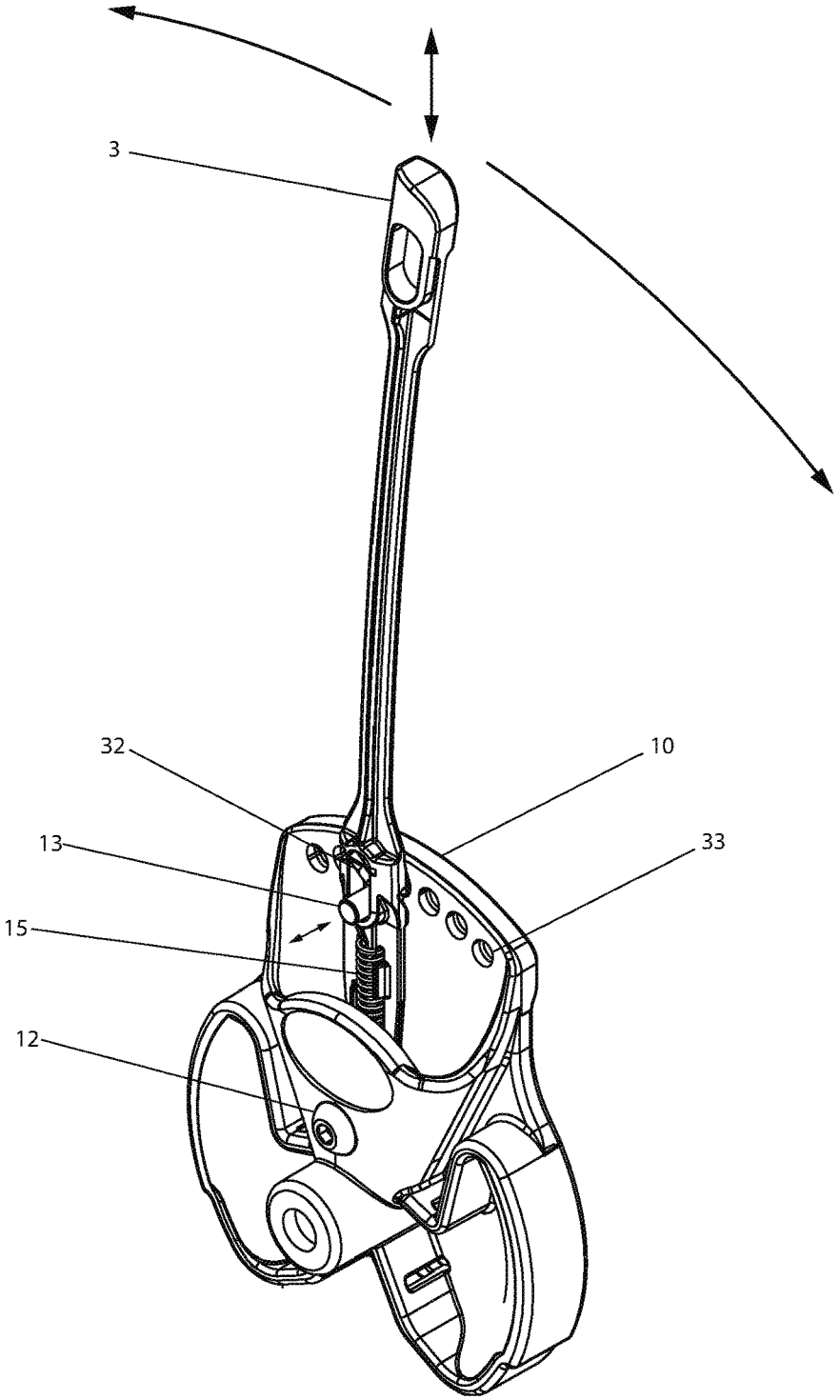
FIG. 6 is an isometric view of the internal components of the invention showing the range of adjustment made possible by the invention.
Figure 7:
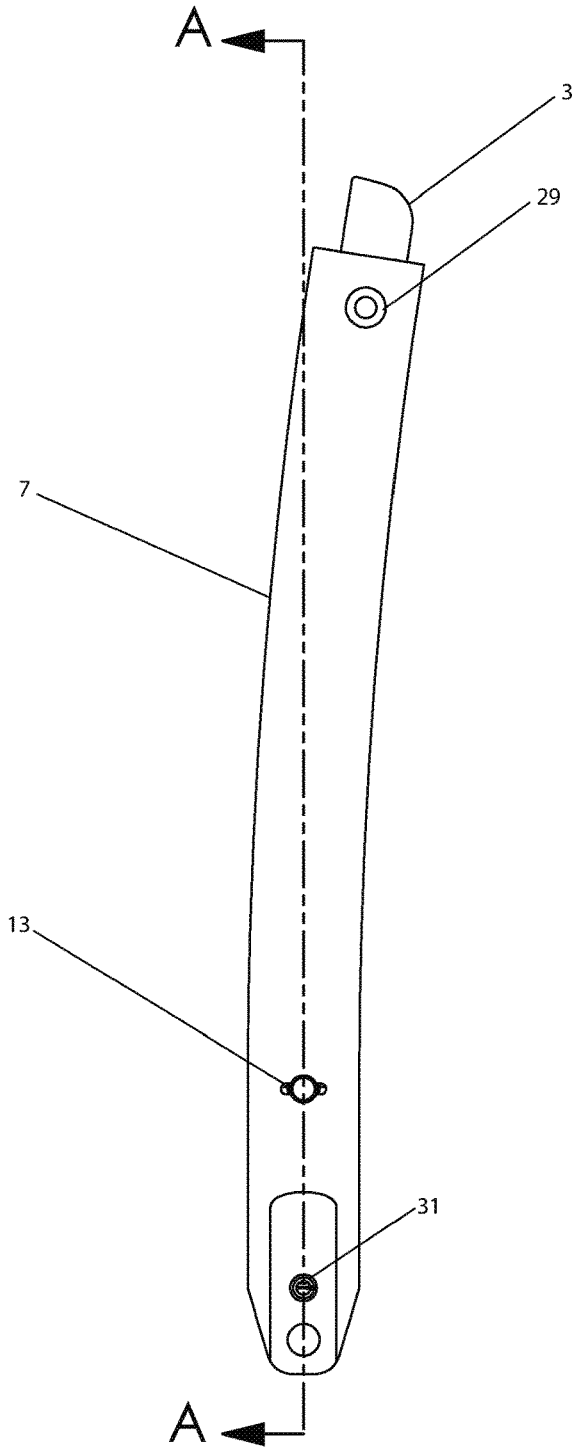
FIG. 7 is a side plan view of one of the pedal cranks equipped with the adjustment system of this invention.
Figure 8:
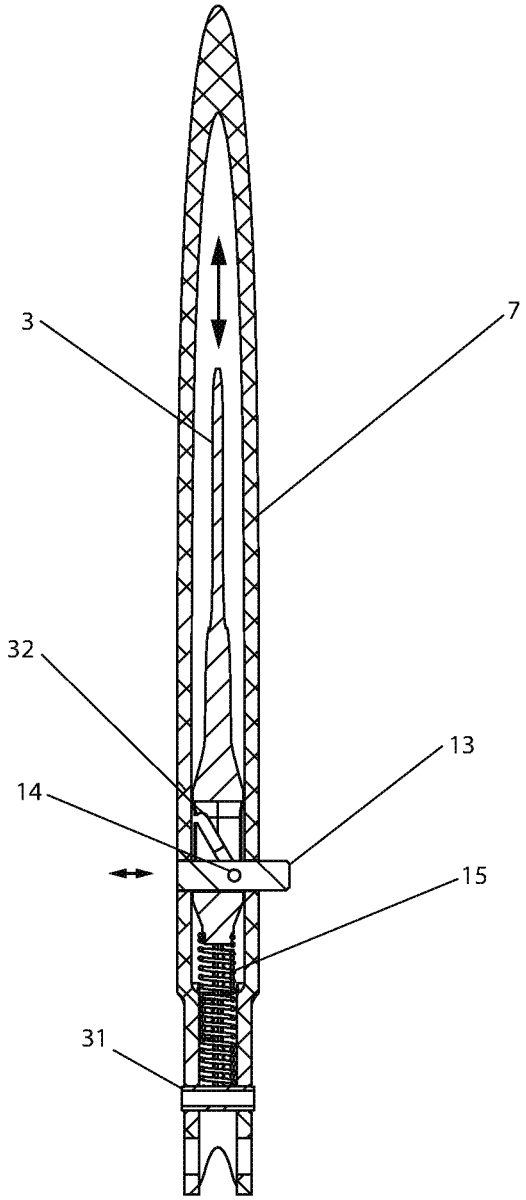
FIG. 8 is a section view along the line A-A in FIG. 7 showing the internal components of the invention showing the motion of the adjustment system.
Figure 9:
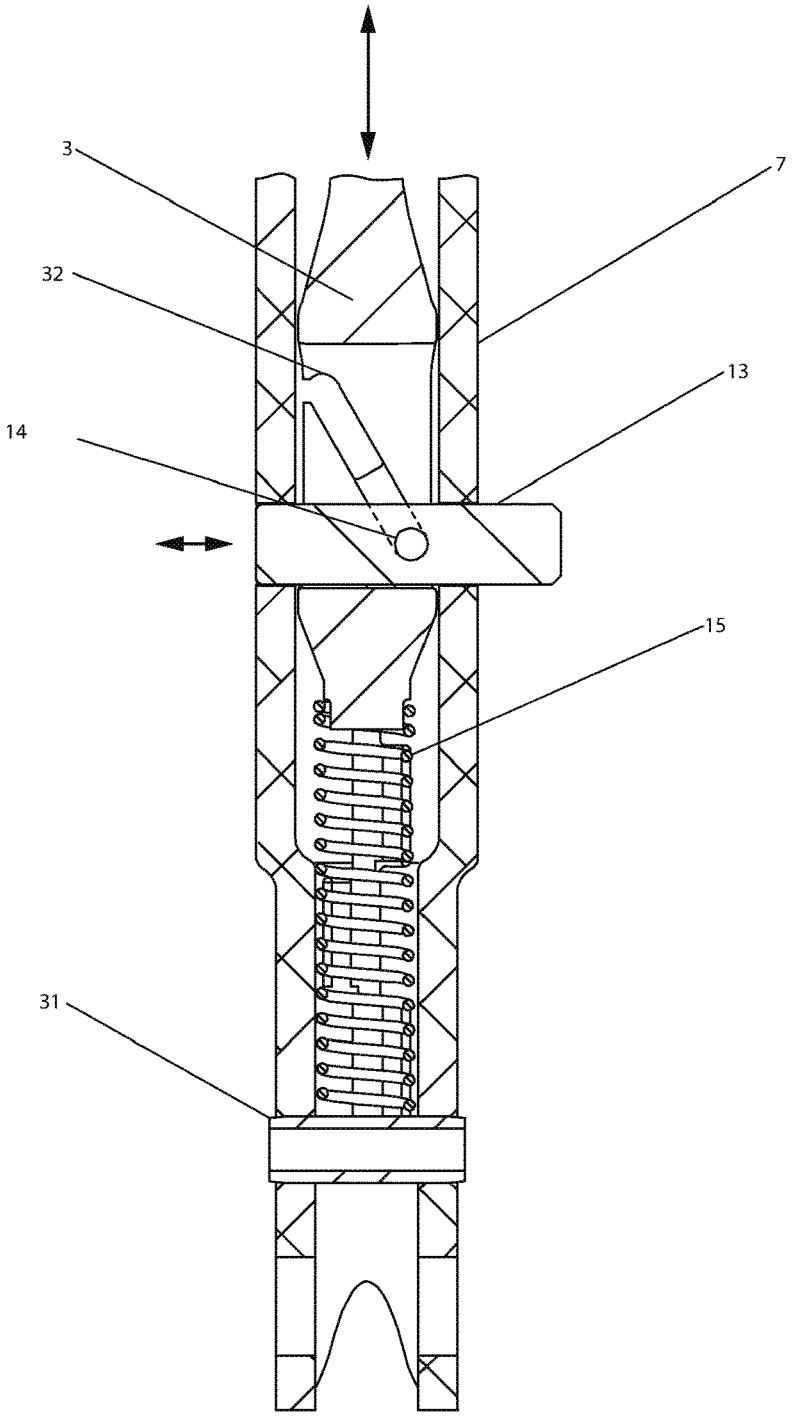
FIG. 9 is an exploded section of the invention along the line A-A.

One preferred embodiment is an adjustment system for human powered propulsion watercraft 16 with fins 17, 18 protruding below the waterline of watercraft. The invention allows a user to adjust crank 7, 8 and attached pedal 1, 2 positions to accommodate different human leg lengths. The mechanism converts vertical motion applied to the top of manually operable button core 3, 4 into a remote horizontal sliding action on a reciprocating pin 13 by means of an inclined track 32 to which a transverse pin 14 fits within. The reciprocating pin 13 is constrained by a hole through the crank 7, 8 and thus is only able to move horizontally in a reciprocating sliding motion along its major axis.

The button core 3, 4 made from a low friction plastic such as nylon is constrained to only move vertically up and down by the profile of the crank 7, 8 which houses it, reciprocating the pin 13 and the pedal axle 29. As the button core 3, 4 is depressed vertically, the transverse pin 14 slides up an inclined track 32 constrained vertically by the reciprocating pin 13 and compresses a spring 15 against the fixed horizontal shaft 31. To ensure ease of use, this inclined track 32 is angled such that for every two units of distance the button 3, 4 is depressed, the reciprocating pin 13 moves 1 unit. A near 2:1 force ratio is achieved.

The transverse pin 14 is welded by friction to the reciprocating pin 13, its motion up the inclined track 32 directly forces said reciprocating pin 13 to slide horizontally and retract from a hole 33 in the rotatable pedal supports and cable guides 9, 10. With the device in its retracted state, the user can freely rotate the crank 7, 8 around the pivot bolt 11, 12 within the bounds of rotatable pedal supports and cable guides 9, 10 housing to accommodate different human leg lengths.

To lock the crank 7, 8 and pedal 1, 2 to a new position, the user aligns a desired hole 33 on the rotatable pedal supports and cable guides 9, 10 with the reciprocating pin 13 according to their leg length and releases the force applied to the button core 3, 4. The compressed spring 15 then acts on the released button core 3, 4, forcing it upwards. This in turn acts on the transverse pin 14 such that it travels down the inclined track 32 and forces the reciprocating pin 13 to move horizontally into the new hole 33 within the rotatable pedal supports and cable guides 9, 10. This action locks the crank 7, 8 and pedal 1, 2 into position within the human powered watercraft propulsion device.

With the reciprocating pin 13 locked into a desired hole 33 within the rotatable pedal supports and cable guide 9, 10, pedals 1, 2 transmit the user's input force by means of a pedal shaft 29 fixed to the top of the cranks 7, 8. The lower section of the cranks 7, 8 are fixed to the rotatable pedal supports and cable guides 9, 10 with the pivot bolt 11, 12. The rotatable pedal support and cable guide 9, 10 pivot in an arcurate back and forth motion around a lateral axle 21. The lateral axle 21 is fixed within a longitudinal structural spine 24 to which forms the central mounting of the propulsive device.

In the preferred embodiment for the "lower unit", power is transferred to the propulsion device from the rotatable pedal supports and cable guides through cables 19, 20 extending down to a pair of sprockets 27, 28. Each sprocket 27, 28 is mounted to rotating longitudinal drums 25, 26. Each longitudinal drum 25, 26 made from a low friction engineering plastic such as nylon acts as a bearing and rotates on a longitudinal axle 34, 35 connected to the spine 24 which supports the propulsion mechanism in the opening in the bottom of the watercraft. The idler pulley 23 prevents the over-stressing of cables 19, 20 in the event the user has both feet pressed against pedals 1, 2.

The longitudinal drums 34, 35 carry radially extending rigid masts, respectively. The masts 36, 37 project in a generally downward direction so that they always remain in the water and do not contact the underside of the hull. The masts 38, 39 support the fins or flappers 17, 18 at the leading edges, respectively, at their leading edges. Each of the fins 17, 18 is rotatable about its mast 38, 39, so that the edge of the fins 17, 18 opposite the leading edge can move from one to the other with respect to the center line of the longitudinal drums 25, 26. This action results in both fins 17, 18 exerting a forward force or push on the watercraft in a direction transverse to the movement of the fins 17, 18, providing superior efficiency and speed. The extent of travel or movement of the trailing edges is limited by the adjustment provided by the main sheet tensioners 38, 39.

With pedal shafts in the locked position on pedal supports and cable guides 9, 10, human input force on the pedals 1, 2 is directly transferred to the power generating fins 17, 18. With the propulsion device fixed into position within the watercraft 16. It is essential that the invention can accommodate different human leg lengths to operate the propulsion method.

The invention provides a simple push button method of adjusting said propulsion craft so that the user is more easily able to access the adjustment method. Having the button core 3, 4 at the top of the crank 7, 8 gives the user easy access to the adjustment method.

The invention further includes a novel device for adjusting a human propelled watercraft. The invention allows the user to position the propulsion device to accommodate different human leg lengths. The invention translates the user's vertical motion into a horizontal motion of a locking pin. This horizontal motion allows a locking pin to retract from a positional hole into a new positional hole. Once the new location is selected, a vertical spring forces acts on the mechanism to return the locking pin to its original horizontal (locked) position. The watercraft is typically a kayak or any similar watercraft such as a boat, catamaran and the like, normally human propelled. The watercraft may, but not necessarily, include a hull having a keel and a cockpit.

What is claimed:

1. An apparatus adapted to be placed in a watercraft extending through an opening in the bottom of the watercraft, said apparatus comprising:

a propulsion means comprising a pair of flexible fins extending below the waterline adapted to oscillate through an arcuate path about a horizontal axis to propel said watercraft;

means operatively associated with said propulsion means for applying input force including a pair of flexible drive members running from said propulsion means to rotatable supports having a plurality of spaced apart adjustment holes therein;

flexible drive members being coupled to each of said rotatable supports;

a pair of elongated members each carrying a pedal;

each said elongated member having a locking means therein slidably engageable and disengageable with said adjustment holes;

said locking means being operatively coupled to manually operable means at the distal end of said elongated member whereby when said manually operable means is depressed, said locking means is withdrawn from said adjustment holes and said elongated member can be rotated relative to said rotatable support and when said elongated member is rotated so that said locking means is aligned with another adjustment hole and said manually operable means is released, said elongated member is locked to said rotatable support by said locking means and said pedal is positioned according to the leg length of the user and when input force is applied to said pedals, said flexible fins oscillate through an arcuate path.

2. The apparatus of claim 1 wherein each said elongated member is hollow and wherein when said manually operated means is depressed, the vertical motion thereof is operatively coupled to means to convert said vertical motion to horizontal motion allowing said locking means to retract and upon release of said manually operated means to reverse the motion of the locking means to lock said elongated member to said rotatable support.

3. The apparatus of claim 1 wherein said flexible drive members are cables.

4. The apparatus of claim 1 wherein said elongated members are pedal cranks.

5. The apparatus of claim 1 wherein said manually operable means is a push button.

6. The apparatus of claim 1 wherein said watercraft is a kayak.

7. The apparatus of claim 1 wherein said locking means includes a slidable pin.

8. A watercraft comprising:

an apparatus extending through an opening in the bottom of said watercraft;

said device comprising a propulsion means comprising a pair of flexible fins extending below the waterline adapted to oscillate through an arcuate path about a horizontal axis to propel said watercraft;

means operatively associated with said propulsion means for applying input force include a pair of flexible drive members running from said propulsion means to rotatable supports having a plurality of spaced apart adjustment holes therein;

said supports carrying said flexible drive members being coupled to each of said rotatable supports;

a pair of elongated members each carrying a pedal;

each said elongated member having a locking means therein slidably engageable and disengageable with said adjustment holes;

said locking means being operatively coupled to manually operable means at the distal end of each said elongated member, whereby when said manually operable means is depressed, said locking means is withdrawn from said adjustment holes and said elongated member can be rotated relative to said rotatable support and when said elongated member is rotated so that said locking means is aligned with another adjustment hole and said manually operable means is released, said elongated member is locked to said rotatable support by said locking means and said pedal is positioned according to the leg length of the user and when input force is applied to said pedals, said flexible fins oscillate through an arcuate path.

9. The watercraft of claim 8 wherein each said elongated member is hollow and wherein when said manually operated means is depressed, the vertical motion thereof is operatively coupled to means to convert said vertical motion to horizontal motion allowing said locking means to retract and upon release of said manually operated means to reverse the motion of the locking means to lock said elongated member to said rotatable support.

10. The watercraft of claim 8 wherein said flexible drive members are cables.

11. The watercraft of claim 8 wherein said elongated members are pedal cranks.

12. The watercraft of claim 8 having wherein said manually operable means is a push button.

13. The watercraft of claim 8 wherein said watercraft is a kayak.

14. The watercraft of claim 8 wherein said locking means includes a pin.

* * * * *